US009885219B2

(12) United States Patent
Halbert et al.

(10) Patent No.: US 9,885,219 B2
(45) Date of Patent: Feb. 6, 2018

(54) NON-RELEASING ANCHOR TOOL WHEN JARRING UP ON A STUCK SUBTERRANEAN TOOL COMPONENT

(71) Applicant: BAKER HUGHES INCORPORATED, Houston, TX (US)

(72) Inventors: Brandon M. Halbert, Lafayette, LA (US); Christy A. Haynes, Lafayette, LA (US)

(73) Assignee: Baker Hughes, a GE company, LLC, Houston, TX (US)

( * ) Notice: Subject to any disclaimer, the term of this patent is extended or adjusted under 35 U.S.C. 154(b) by 209 days.

(21) Appl. No.: 14/869,230

(22) Filed: Sep. 29, 2015

(65) Prior Publication Data

US 2017/0089160 A1 Mar. 30, 2017

(51) Int. Cl.
*E21B 31/107* (2006.01)

(52) U.S. Cl.
CPC ..... *E21B 31/107* (2013.01)

(58) Field of Classification Search
CPC ..... E21B 31/107; E21B 31/12
See application file for complete search history.

(56) References Cited

U.S. PATENT DOCUMENTS 1,445,680 A * 2/1923 Guess ..... E21B 31/002 294/86.2
4,574,889 A * 3/1986 Pringle ..... E21B 34/102 166/323
6,880,641 B2 * 4/2005 Dennistoun ..... E21B 29/08 166/192
6,902,006 B2 * 6/2005 Myerley ..... E21B 29/08 166/332.8
6,953,093 B2 * 10/2005 Dennistoun ..... E21B 29/08 166/192
6,991,040 B2 * 1/2006 Hill, Jr. ..... E21B 34/102 166/323
7,347,268 B2 * 3/2008 Layton ..... E21B 23/04 166/332.1
7,347,269 B2 3/2008 Layton
7,717,185 B2 * 5/2010 Anderson ..... E21B 34/10 166/332.8
2003/0075336 A1 * 4/2003 Dennistoun ..... E21B 29/08 166/373
2003/0192703 A1 * 10/2003 Williams ..... E21B 34/00 166/376
2004/0007365 A1 * 1/2004 Hill, Jr. ..... E21B 34/102 166/386

(Continued)

*Primary Examiner* — James G Sayre
(74) *Attorney, Agent, or Firm* — Steve Rosenblatt

(57) ABSTRACT

A grip a no goes in a subterranean tool to properly position grip members held radially outward with a cone on delivery of an uphole force. In the case of a subsurface safety valve that has a flow tube the slips are wedged into the flow tube when the grip tool lands on the no go in the subsurface safety valve and is jarred up. Jarring up using spang jars and weight bars can be repeatedly accomplished without releasing the grip tool from the flow tube. Jarring down unsupports the slips to allow them to retract while one or more springs can be used to prevent a re-grip of the flow tube. The grip tool can now be pulled out of the hole with the flow tube broken loose from accumulated debris for subsequent normal operation of the flow tube with the control system for the subsurface safety valve.

19 Claims, 2 Drawing Sheets

(56) References Cited

U.S. PATENT DOCUMENTS

| | | | | |
|---|---|---|---|---|
| 2004/0065442 | A1* | 4/2004 | Myerley | E21B 29/08 166/373 |
| 2006/0113081 | A1* | 6/2006 | Dennistoun | E21B 29/08 166/321 |
| 2009/0114389 | A1* | 5/2009 | Dennistoun | E21B 29/08 166/277 |
| 2009/0294136 | A1* | 12/2009 | Jones | E21B 19/22 166/386 |
| 2010/0006296 | A1* | 1/2010 | Anderson | E21B 34/102 166/332.8 |
| 2014/0290939 | A1* | 10/2014 | Williamson | E21B 34/10 166/250.01 |
| 2015/0184488 | A1* | 7/2015 | Williamson | E21B 34/102 166/375 |
| 2016/0102514 | A1* | 4/2016 | Miller | E21B 31/107 166/301 |

* cited by examiner

NON-RELEASING ANCHOR TOOL WHEN JARRING UP ON A STUCK SUBTERRANEAN TOOL COMPONENT

FIELD OF THE INVENTION

The field of the invention is grip tools to engage a stuck component in a subterranean tool and more particularly grip tools that do not release when jarred up to allow repetitive jarring up followed by jarring down to effect release to pull out of the hole.

BACKGROUND OF THE INVENTION

Subterranean tools tend to remain in a single position for an extended period of time. During that interval debris in the borehole or debris that comes from the formation into the borehole can get between moving parts and in effect seize them together to the point that the actuation components designed to normally relatively move such components are incapable of budging the stuck component.

One example of this is a subsurface safety valve that has a flapper operated by a flow tube that is in turn moved down with a piston moved by pressure in a control line running to the surface. Movement of the flow tube in the downhole direction rotates the flapper 90 degrees so that the flow tube can be moved down and cover over the flapper. In this position the safety valve is open. It can stay in this position for months or years. Some operators exercise such valves periodically to try to prevent seizing by exercising the flow tube before too much debris accumulates. Such tools do not involve jars but the objective is to move a flow tube in opposed directions before there is significant debris buildup. Such tools are described in U.S. Pat. Nos. 7,347,268 and 7,347,269.

Other tools used to lock subsurface safety valves open generally combine weights and spang jars to jar down to move either a flow tube or adjacent sleeve into a position where the flapper cannot close. These designs are shown in U.S. Pat. No. 6,991,040.

Tools that grip a stuck component for jarring up generally have a feature for automatic tool release with the first jarring action to enable removal of the anchor tool and jars. This is illustrated with shear pin 7 in the context of a tool that deforms the flow tube in the down position and locks that position as described in column 5 of U.S. Pat. No. 4,574,889. Other tools lock open a subsurface safety valve by jarring up a sleeve under the flow tube in a single motion as illustrated in U.S. Pat. No. 7,717,185.

What is needed and provided by the present invention is a grip tool that can be jarred up repeatedly without release and subsequently released to pull out of the hole while held in a position to prevent getting another grip. These and other aspects of the present invention can be more fully understood with the aid of the detailed description of the preferred embodiment and the associated drawings while recognizing that the full scope of the invention is to be determined from the appended claims.

SUMMARY OF THE INVENTION

A grip no goes in a subterranean tool to properly position grip members held radially outward with a cone on delivery of an uphole force. In the case of a subsurface safety valve that has a flow tube the slips are wedged into the flow tube when the grip tool lands on the no go in the subsurface safety valve and is jarred up. Jarring up using spang jars and weight bars can be repeatedly accomplished without releasing the grip tool from the flow tube. Jarring down unsupports the slips to allow them to retract while one or more springs can be used to prevent a re-grip of the flow tube. The grip tool can now be pulled out of the hole with the flow tube broken loose from accumulated debris for subsequent normal operation of the flow tube with the control system for the subsurface safety valve.

DETAILED DESCRIPTION OF THE PREFERRED EMBODIMENT

Presented below is a table of the part names associated with the number bubbles in FIG. 1:

| Number | Description |
|---|---|
| 1 | Top Sub |
| 2 | Cylinder Sub |
| 3 | Spring Housing |
| 4 | Piston |
| 5 | Flow Tube |
| 9 | Flapper |
| 10 | Bottom Sub |
| 13 | Upper Mandrel |
| 14 | Lower Mandrel |
| 15 | Slip Ramp |
| 16 | Carrier Sleeve |
| 17 | Slip Retainer |
| 18 | Locking Dogs |
| 19 | Setting Spring |
| 20 | Releasing Sleeve |
| 21 | Shear Sleeve |
| 22 | Releasing Spring |
| 23 | Spacing Sleeve |
| 24 | No Go Ring |
| 25 | Spacing Key |
| 26 | Spacing Cap |
| 27 | Shear Stock |

Figure 1:
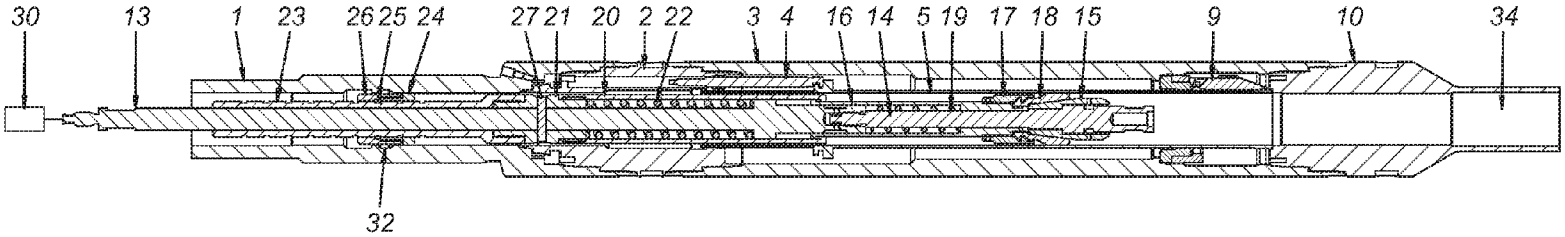
FIG. 1 is a section view of the grip tool being run into a flow tube type subsurface safety valve.
Figure 2:
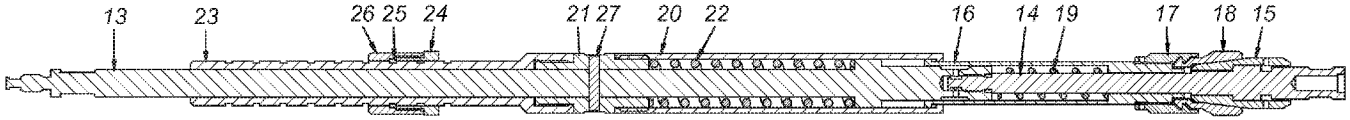
FIG. 2 is the view of FIG. 1 showing the locking dogs extended toward the flow tube that is not shown in this view.
Figure 3:
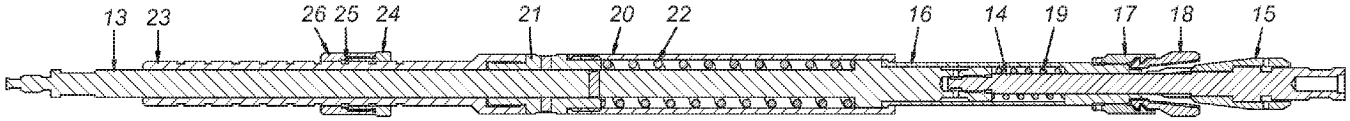
FIG. 3 is the view of FIG. 2 after jarring down so that the cone is spaced from the locking dogs.

In FIG. 1 the upper mandrel 13 is supported by a slickline with spang jars and weight bars and is schematically represented as 30. All the equipment represented by item 30 is well known in the art and allows jarring in an uphole direction to try to free the flow tube 5 as well as jarring down to break the shear stock 27 so that slip ramp 15 can be moved relative to the locking dogs or slips 18 as seen in the FIG. 3 position so that another grip of the flow tube 5 cannot be obtained. FIG. 3 shows the shear stock 27 sheared from a jar down force from item 30 that in turn allows spring 22 to extend and slip ramp 15 to be pushed axially away from slips 18 causing them to lose support.

For running in, the spacer sleeve is used to position the slips 18 in the flow tube 5 by locating the assembly of no go ring 24, the spacing key 25 and the spacing cap 26 to land and find support in the groove 32 in the top sub 1 as shown in FIG. 1. While running in to the no go position of FIG. 1 the ramp 15 is positioned away from the slips 18 to facilitate insertion into top sub 1. Any upward jarring will cause a wedging action of the slips 18 by the ramp 15. This holds true for however many uphole jarring blows are administered by item 30. The flow tube 5 will continue to be gripped by the slips 18. If the flow tube 5 breaks loose then it should be able to move uphole to the point that the flapper 9 that was covered by the flow tube 5 will be able to rotate in the clockwise direction to close passage 34.

For coming out of the safety valve including the top sub 1, cylinder sub 2, spring housing 3 and bottom sub 10, the release spring 22 keeps the tool extended after shear stock 27 shears. In so doing the force of spring 22 pushes up release sleeve 20 that takes with it carrier sleeve 16 and slip retainer 17 with slips 18. In that manner another grip of the flow tube 5 for coming out of the hole is avoided.

Those skilled in the art will appreciate that the grip tool can enter the safety valve and get accurately positioned with the use of the groove 32. From that latched position jarring up on the upper mandrel 13 will support slips 18 against the flow tube 5 for repeated jars up without release of the grip tool. However, a first jarring down will shear the shear stock 27 and allow tool extension under the force of spring 22 such that another grip of the flow tube 5 is disabled. The tool is removed with the slickline. The tool allows multiple uphole jarring blows to try to get a flow tube from a pushed down position back up so that the safety valve can close followed by an orderly release by jarring down and then pulling out of the hole.

Other types of devices can be jarred loose with slickline without tool release. One example may be a sliding sleeve.

The above description is illustrative of the preferred embodiment and many modifications may be made by those skilled in the art without departing from the invention whose scope is to be determined from the literal and equivalent scope of the claims below:

We claim:

1. A grip tool for jarring free a component of a subterranean tool, comprising:

a mandrel;

a gripping assembly mounted to said mandrel, said gripping assembly in a retracted position for insertion into the component of the subterranean tool and an extended position against the component when jarring on said mandrel;

said mandrel retains a grip on the component when jarred in the direction out of the component and said mandrel releases said component when jarred in the direction into the component allowing said mandrel and the entire gripping assembly to be removed from the component.

2. The tool of claim 1, wherein:

said mandrel is supported on a slickline.

3. The tool of claim 2, wherein:

said mandrel further comprises at least one jar supported by said slickline.

4. The tool of claim 3, wherein:

said jar can impart multiple jarring blows to said mandrel in a direction that would separate said mandrel from the component without release of the component by said slip.

5. The tool of claim 4, wherein:

said jar can impart a single jarring blow to said mandrel in a direction that would further insert said mandrel into the component for a release of the component by said slip.

6. The tool of claim 1, wherein:

said gripping assembly further comprises at least one slip and associated cone wherein jarring on said mandrel in a direction out of the component one or more times causes said cone to wedge said slip against the component.

7. The tool of claim 6, wherein:

jarring on said mandrel in a direction out of the component multiple times retains said slip wedged to the component with said cone.

8. A grip tool for jarring free a component of a subterranean tool, comprising:

a mandrel.

a gripping assembly mounted to said mandrel, said gripping assembly in a retracted position for insertion into the component of the subterranean tool and an extended position against the component when jarring on said mandrel;

said mandrel retains a grip on the component when jarred in the direction out of the component and said mandrel releases said component when jarred in the direction into the component;

the component comprises a flow tube in a subsurface safety valve.

9. The tool of claim 1, wherein:

said mandrel further comprises a travel stop for positioning said gripping assembly opposite the component.

10. A grip tool for jarring free a component of a subterranean tool, comprising:

a mandrel;

a gripping assembly mounted to said mandrel, said gripping assembly in a retracted position for insertion into the component of the subterranean tool and an extended position against the component when jarring on said mandrel;

said mandrel retains a grip on the component when jarred in the direction out of the component and said mandrel releases said component when jarred in the direction into the component;

jarring said mandrel in the direction into the component overcomes a retainer to allow moving said gripping assembly to move apart.

11. The tool of claim 10, wherein:

said mandrel further comprises at least one biasing member to maintain said gripping assembly apart after said retainer is overcome.

12. The tool of claim 10, wherein:

said mandrel comprises spaced apart mounting locations for said travel stop.

13. A grip tool for jarring free a component of a subterranean tool, comprising:

a mandrel;

a gripping assembly mounted to said mandrel, said gripping assembly in a retracted position for insertion into the component of the subterranean tool and an extended position against the component when jarring on said mandrel;

said mandrel retains a grip on the component when jarred in the direction out of the component and said mandrel releases said component when jarred in the direction into the component;

said gripping assembly further comprises at least one slip and associated cone wherein jarring on said mandrel in a direction out of the component one or more times causes said cone to wedge said slip against the component;

jarring on said mandrel in a direction into the component one time releases said slip from being wedged to the component with said cone;

the component comprises a flow tube in a subsurface safety valve.

14. The tool of claim 13, wherein:

said mandrel further comprises a travel stop for positioning said slip opposite the component.

15. The tool of claim 14, wherein:

jarring said mandrel in the direction into the component overcomes a retainer to allow moving said cone and said slip to move apart.

16. The tool of claim 15, wherein:

said mandrel further comprises at least one biasing member to maintain said slip and cone apart after said retainer is overcome.

17. The tool of claim 16, wherein:

said mandrel comprises spaced apart mounting locations for said travel stop.

18. The tool of claim 17, wherein:

said mandrel is supported on a slickline.

19. The tool of claim 18, wherein:

said mandrel further comprises at least one jar supported by said slickline.

* * * * *